US008752746B2

(12) United States Patent
Dee

(10) Patent No.: US 8,752,746 B2
(45) Date of Patent: Jun. 17, 2014

(54) COMBINATION SKATEBOARD SHOULDER STRAP AND GARMENT BELT

(76) Inventor: Glenn Dee, Omaha, NE (US)

( * ) Notice: Subject to any disclaimer, the term of this patent is extended or adjusted under 35 U.S.C. 154(b) by 35 days.

(21) Appl. No.: 13/472,257

(22) Filed: May 15, 2012

(65) Prior Publication Data

US 2012/0292362 A1 Nov. 22, 2012

Related U.S. Application Data

(60) Provisional application No. 61/486,571, filed on May 16, 2011.

(51) Int. Cl.
*A45F 3/14* (2006.01)

(52) U.S. Cl.
USPC ..... 224/578; 224/581; 224/586; 224/660; 224/250; 224/257; 224/264

(58) Field of Classification Search
USPC ..... 224/257, 258, 264, 660, 254, 250, 925, 224/581, 586, 576, 578
See application file for complete search history.

(56) References Cited

U.S. PATENT DOCUMENTS

| | | | | | |
|---|---|---|---|---|---|
| 2,530,695 | A | * | 11/1950 | Helmert | 224/586 |
| 2,845,670 | A | * | 8/1958 | Brown et al. | 24/16 R |
| 4,337,883 | A | | 7/1982 | Pate | |
| 4,483,470 | A | * | 11/1984 | Cousins | 224/257 |
| 4,790,460 | A | * | 12/1988 | Harper, Jr. | 224/644 |
| 5,344,056 | A | | 9/1994 | Challoner | |
| 5,437,401 | A | | 8/1995 | Seltzer | |
| 5,492,254 | A | * | 2/1996 | Challoner et al. | 224/586 |
| 5,690,261 | A | * | 11/1997 | Moore | 224/578 |
| 5,746,361 | A | | 5/1998 | Johnson | |
| D455,259 | S | * | 4/2002 | Kelly-Pollet | D3/221 |
| 6,371,346 | B1 | | 4/2002 | Sharma | |
| 6,536,639 | B1 | | 3/2003 | Frank | |
| D614,864 | S | * | 5/2010 | Clayton | D3/221 |
| 2010/0206930 | A1 | * | 8/2010 | Sims | 224/607 |

* cited by examiner

*Primary Examiner* — Justin Larson
(74) *Attorney, Agent, or Firm* — Global Intellectual Property Agency, LLC

(57) ABSTRACT

A skateboard carrying strap is disclosed for holding a skateboard against a user's back, wherein the strap comprises two separable sections. Each section comprises a complimentary belt buckle end and a skateboard securement end. On each securement end are extendable elastic bands, are placed around the wheel trucks of a skateboard to support the skateboard. The user wears the assembly across his or her torso, crossing over the shoulder, while the skateboard deck lies against the individual's back with the wheel trucks facing away from the body and in connection with the elastic bands. The belt buckle end comprises a belt buckle or clasp engagement adapted to rest against the user's chest, while the disconnected securement ends of each section are adapted to secure each skateboard wheel truck. When the device is not in use, the strap lengths can be connected into a continuous section for use as traditional belt.

5 Claims, 2 Drawing Sheets

COMBINATION SKATEBOARD SHOULDER STRAP AND GARMENT BELT

CROSS REFERENCE TO RELATED APPLICATION

This application claims the benefit of U.S. Provisional Application No. 61/486,571 filed on May 16, 2011, entitled "Skateboard Shoulder Strap."

BACKGROUND OF THE INVENTION

1. Field of the Invention

The present invention relates to skateboard carrying devices. More specifically, the present invention is a convertible strap that attaches to a skateboard and wraps over the shoulder of an individual, whereafter the strap can be utilized as a traditional pants belt. The device is intended to allow individuals to carry the skateboard on their back, thus maintaining the free use of their hands for other tasks. When the device is deployed, the strap is disconnected along the user's back and in connection around each wheel truck. When not in use, the strap is continuous and forming an appropriate length and structure such that it may be utilized as a standard belt around a user's waist.

2. Description of the Prior Art

Skateboarding provides outdoor recreational enjoyment for many individuals. Some individuals use a skateboard for purely recreational reasons, while others utilize the device as their primary means of transportation, as the use of a skateboard is often faster than simply walking to get to a destination. When not in use, skateboarders are forced to carry their boards. Skateboarders are often not permitted to use skateboards in certain locations that they may otherwise desire to ride. Some city ordinances prohibit skateboarders from skating in public places where there are many other people who could accidentally be stricken or hurt by a careless skateboarder. In these locations, a skateboarder must carry his or her skateboards and not use them. Carrying one's skateboard can be burdensome as the skateboard itself can be rather bulky and cumbersome to comfortably hold for long periods of time by hand. Maintaining free hands is also highly desirable and skateboarders would appreciate a means of holding a skateboard that keeps their hands free.

The present invention is an over-the-shoulder strap for use carrying a skateboard on one's back that also provides a convenient and size-appropriate belt system when not in use. The device is a separable strap a first and second elongated section, each having a complimentary buckling end/buckle receiving end and skateboard securement end. Each securement end comprises a set of elastic bands adapted to attach around a skateboard wheel truck. In use, the buckle ends are connected and placed over the user's check, while the securement ends are separated and utilized to support each skateboard wheel truck individual and against the user's back. An individual stretches the elastic bands from the strap around the board such that the bands wrap around the sides of the board and around the base of each wheel truck on the skateboard lower surface. Once the strap device is attached to the skateboard, an individual wears the strap around his or her torso by crossing the strap over the individual's shoulder, wherein the skateboard lies against the individual's back. The wheel trucks of the skateboard face outward, away from the body, while the smoother upper deck section of the board rests against the strap and the individual's back.

The key feature of the present invention is the separable nature of the strap, wherein a shortened overall length is achieved such that the user may utilize the strap as a belt when not carrying a skateboard. The skateboard securement ends are separable such that the strap need not be overly elongated to form an over-the-shoulder strap system. The ends separate and connect to the skateboard wheel trucks via elastic bands, whereafter the ends can be joined to form a continuous belt section when the device is not in use. The elastic bands are further securable along the length of the strap for stowage between uses, further facilitating the strap use as a belt when not supporting a skateboard.

Several inventive attempts to address the challenges associated with carrying a skateboard have been disclosed in the prior art. For example, U.S. Pat. No. 6,371,346 to Sharma describes a device that serves both as a belt and as a sling for carrying large, bulky items such as snowboards or inline skates. The device is a belt that is worn around the waist of an individual allowing the individual to carry cargo while maintaining free hands. The device has two cargo carrying loops for attaching to an item which requires transportation. The loops are open and closable and attach to the cargo, fastening the cargo to the belt device. If it is impractical to wear the device as a belt while loaded with cargo, an individual is able to remove the belt from around his or her waist and, instead, sling the device over his or her shoulder. The individual retains free use of his or her hands when the device is used in this way. The present invention provides a similar style device adapted for carrying bulk items, and in particular skateboard, wherein the loop attachment means of the present invention are elastic bands that are alignable and affixable along the strap length, wherein the strap may be condensed into an aligned assembly such that the strap may function as a normal pants belt. The Sharma device provides a more ruggedized structure having strap material for each support loop that are not readily alignable for creating a pants belt between uses as a luggage carrier. The present invention is further more adapted to provide a waist belt when not in use as a skateboard holder.

Further, U.S. Pat. No. 6,536,639 to Frank describes a skateboard carrying strap for attaching to a skateboard so that an individual can carry the skateboard on his or her back. The strap has a buckle for fastening the strap around one's chest. Two large loops attach to the strap as well. An individual attaches the skateboard to the strap by placing the skateboard against the strap and manipulating the loops so that the loops catch on the wheel trucks of the skateboard. This configuration places the skateboard deck against the individual's back with the wheel trucks facing outward, away from the body. The weight of the skateboard, in conjunction with the force of gravity, keeps the board held in the carrying strap. The Frank device does not disclose a separable strap that allows the overall length of the strap to provide a waist belt that is not overly elongated when not in use as a skateboard holder.

U.S. Pat. No. 5,746,361 to Johnson describes a carrier for transporting a snowboard. The device is a carrier system that resembles a sash, which goes over the individual's shoulder and across the chest. The snowboard is fastened to the device by two sets of buckling straps that attach to the portion of the sash that lies flat against the individual's back. To use the device, an individual fastens the board to the device, taking care to secure the buckling straps at the narrowest section of the snowboard, which is typically the center of the board. Once attached to the device, an individual slips the device over his or her head such that the device crosses over the chest. The length of the board is aligned with the length of the individual's body. When not in use holding a snowboard, the device folds and can be worn around the waist. Another feature of the Johnson device is the incorporation of a locking cable to prevent theft of the device and/or recreational board when it is necessary to leave the device and board unattended. Similar to the Sharma disclosure, the Johnson device does not readily adapt itself for use as a standard pants belt when not in use.

U.S. Pat. No. 5,437,401 to Seltzer describes a personal harness for carrying a variety of items such that the individual is capable of carrying the harnessed item while maintaining free use of the hands. The device has a shoulder strap with a pair of hitching devices that are intended to hold items. The hitching devices comprise of an adjustable strap and a clasping mechanism. The hitching devices connect to the shoulder strap via a slide mechanism to adjust the size of the hitching loop that is formed when the hitching device encompasses an item and clasps into place at the end of the shoulder strap. The Seltzer device is more adapted to provide an article support when carrying larger items using one's shoulder as a support location, as opposed to carrying the article by hand. The device includes a strap that connects to the article in two locations and over the shoulder.

U.S. Pat. No. 5,344,056 to Challoner describes a carrying case for holding a recreational board so that an individual may retain free hands while transporting his or her recreational board. An individual secures his or her recreational board into the device and then wears the device on his or her back, with the length of the board aligned with the length of the individual's body. The device can be manufactured in a variety of sizes for use with surf boards, snow boards, skateboards or similar recreational board. The carrying device has two pockets, with the openings of each pocket facing each other. The pockets are intended to cap the ends of the recreational board, and hold the board in between. An individual tightens a drawstring along the edge of the upper pocket, and the bottom pocket offers a storage pouch where an individual could store his or her keys or wallet. The pockets are tethered to each other by a section of material, on which there are two engagement means. The engagement means fasten around the midsection of the recreational board. When not in use holding a recreational board, the Challoner device can be rolled or folded in upon itself into a tightly packed, compact pouch for easy storage around one's waist, shoulder or back leaving his or her hands free. The Challoner device fails to contemplate a separable section strap that is well adapted to operate as a standard pants belt and skateboard carrier.

U.S. Pat. No. 4,337,883 to Pate describes a skateboard holder that attaches to the belt of a user. The device mounts to an individual's belt and has a strap extending from it. The strap is removable and wraps around one of the wheel trucks of a skateboard, aligning the skateboard with the length of the individual's body. The skateboard hangs from the device against the body of the individual. While the Pate device provides a means of carrying a skateboard and keeps the individual's hands free for other purposes, the skateboard rests against the leg of the individual. Orienting the skateboard in this fashion can make walking an uncomfortable endeavor for the individual. The skateboard brushes against the leg of the individual and could bump into the shin and ankle of the individual causing harm or injury. The present invention fastens tightly to an over-the-shoulder strap and places the deck of the skateboard against the back of the carrying individual, wherein the Pate device is a device attachable to a belt and directed at creating a skateboard holder offshoot therefrom.

The present invention is a skateboard harness that forms a shoulder strap and appropriately sized waist belt, wherein the skateboard wheel trucks are supported by a first and second elastic loop. The loop is securable along the strap length to allow the assembly to be utilized as a common pants belt when not supporting a skateboard. In light of the prior art and the elements of the present invention, it is submitted that the present invention substantially diverges in design elements from the prior art. Consequently it is clear that there is a need in the art for an improvement to existing skateboard carrying devices, which are capable of leaving an individual's hands free. In this regard the instant invention substantially fulfills these needs.

SUMMARY OF THE INVENTION

In view of the foregoing disadvantages inherent in the known types of combination skateboard carrying and garment support devices now present in the prior art, the present invention provides a new improvement for an over-the-shoulder skateboard carrying device wherein a first and second section are provided for separably supporting the wheel trucks of a skateboard and connectively forming a continuous pants belt when not in use.

It is therefore an object of the present invention to provide a new and improved skateboard carrying device that allows for the free use of an individual's hands that has all of the advantages of the prior art and none of the disadvantages.

Another object of the present invention is to provide a means of carrying a skateboard against the back of an individual wherein the means comprises an over-the-shoulder strap that is transformable into a standard pants belt having discontinuous sections for separately carrying a skateboard and then forming a belt of reduced length such that the strap length accommodates a longer, over-the-shoulder length and a smaller, waist size of a user.

Yet another object of the present invention is to provide a means of securely fastening the skateboard to the shoulder strap using a set of elastic bands that wrap around the deck of the board and support the wheel trucks of the skateboard.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
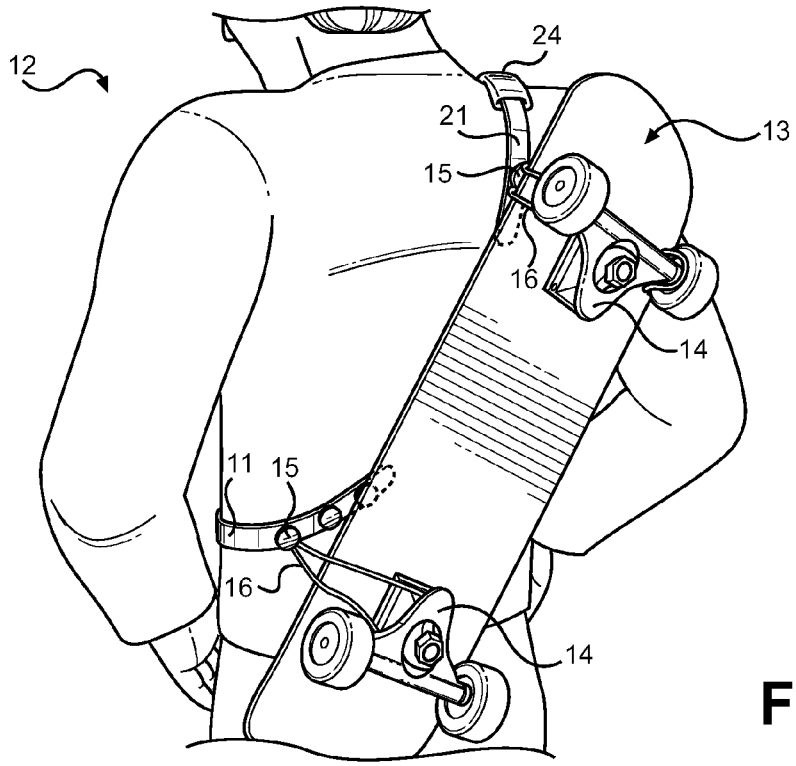
FIG. 1 is a perspective backside view of an individual wearing the present invention and supporting a skateboard on his back. This view depicts how the sections of the strap are separable to support a skateboard across a user's back via the attached elastic bands.

Reference is made herein to the attached drawings. Like reference numerals are used throughout the drawings to depict like or similar elements of the combination skateboard carrying strap and garment support device. For the purposes of presenting a brief and clear description of the present invention, the preferred embodiment will be discussed in one configuration as used for supporting a skateboard on the back of a user such that the individual's hands remain free, while a second configuration is discussed as used as a continuous garment belt. The figures are intended for representative purposes only and should not be considered to be limiting in any respect.

Referring now to FIG. 1, there is shown a backside perspective view of the present invention in a working state, wherein the strap is decoupled and is supporting a skateboard 13 along the back of a user 12. The strap comprises an elongated first 11 and second section 21 that form a length suitable for use as a standard trousers or pants belt. The two sections include a coupling end and a belt engagement end. The coupling ends of each strap length are adapted to allow connection and separation of the lengths via snap button engagement, while the belt engagement end comprises a standard belt buckle or fashion belt connector. The coupling ends are adapted to be connected while the device is utilized as a belt buckle, and separate when being utilized to carry a skate board such that the larger length required to be a shoulder strap is accommodated without unnecessarily lengthening the overall strap lengths such that it would be unsuitable for use as a belt once reengaged. The belt buckle engagement is adapted to stay connected and allow the strap to act as a belt. Adjacent to each engagement snap is an elastic band 16 that attaches to a rotating pin 15 securing the band 16 to each strap section.

Figure 2:
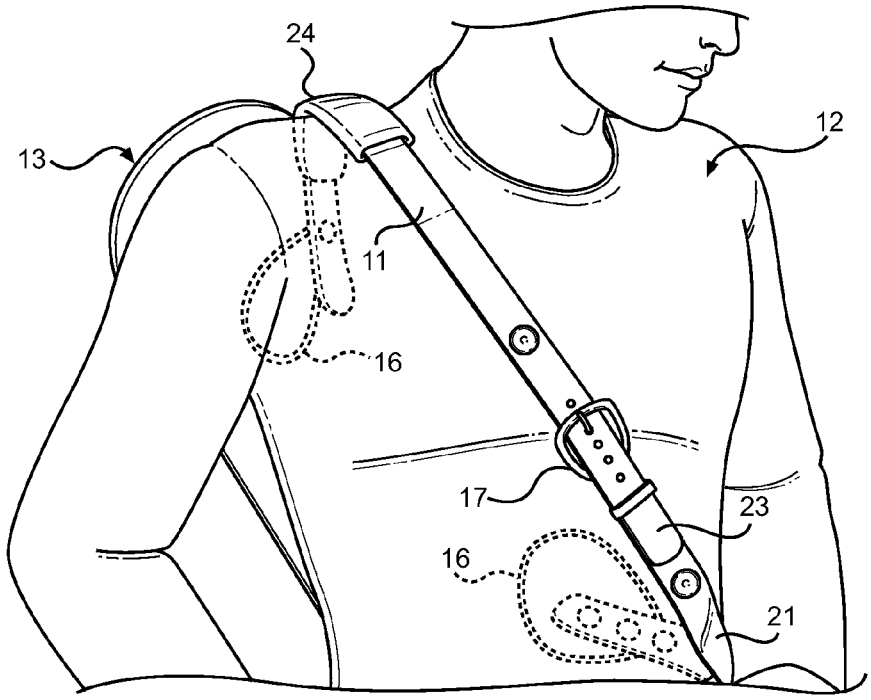
FIG. 2 is a perspective front side view of the device in a working state, wherein the strap is separated and the buckle ends of the strap are connected across the user's chest.

In use strap sections 11, 21 are disconnected from one another and worn across the body and over the shoulder of user 12. The skateboard 13 attaches to the strap sections using the pair of elastic bands 16, wherein the bands are stretched around the wheel trucks 14 of the skateboard 13 to statically support the board 13 against the user's back and while the user is walking. The elastic bands 16 attach to the carrying strap by a rotating rivet or pin 15 having an internal shaft or apertures that the bands are wrap around or travel through. The bands 16 form a continuous loop that are retained within the pin 15 and prevented from separating from the strap sections. Each pin 15 is capable of rotating 360 degrees such that the bands can be rotated into an ideal position when connecting around the skateboard wheel trucks 14. The pin incorporates an internal shaft that allows each band to form either a loop therearound, wherein the band may be fed through the pin 15 on either side of the shaft, or the entire pin 15 may be rotated. The bands are stretched around the sides of the skateboard deck and around each wheel truck 14 to secure the skateboard. Using two bands 16 to wrap around both sides of the skateboard deck keeps the skateboard flat against the individual's back and secured while traveling. Alternatively, the elastic band 16 may be drawn from both sides of the pin 15 and engage each wheel truck 14 from both sides of the board, wherein the bands form two enclosed loops for more rigid securement of the skateboard device. For comfort, a shoulder pad 24 may also be incorporated along the length Referring now to FIG. 2, there is shown a frontal perspective view of the present combination skateboard holder and pants belt in a working position, supporting a skateboard 13 along the back of a user 12. In this view, the belt engagement ends 17, 23 of each strap section 11, 21 are shown in connection utilizing a belt buckle, which offers adjustability in overall strap length when the device is utilized as a shoulder strap or a pants belt. When in use as a carrying device, the coupling ends of the strap sections are decoupled and the elastic bands 16 are utilized to support a skateboard 13 against the back of a user such that he is not required to hold the skateboard by hand. The optional shoulder cushion provides improved comfort if desired by the user, wherein the strap does not bear into the user's shoulder too harshly that it would be uncomfortable or cause irritation.

Figure 3:
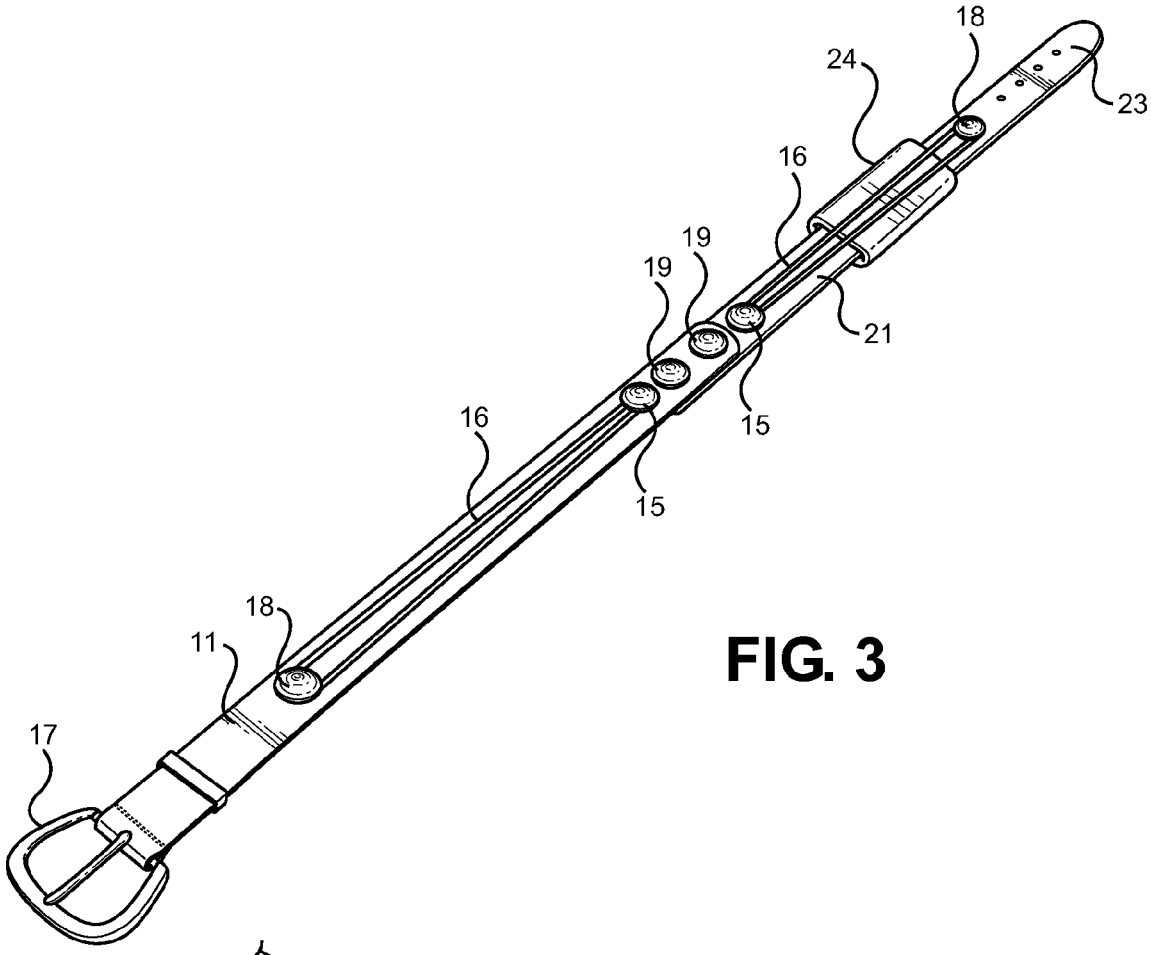
FIG. 3 is a perspective view of the present invention as would be used in a belt configuration and not supporting a skateboard.

Referring now to FIG. 3, there is shown a perspective view of the present strap device in a coupled position, wherein the construction of the device and all of its elements are shown. The strap comprises a first and second elongated section 11, 21 that connect via one or a plurality of snaps 19 to form a continuous length. When connected, the device operates as a standard pants belt, which may be used as a fashion accessory or to hold up a pair of trousers. Along each section is an elastic band retaining pin 18 that is used to secure the elastic bands 16 against the belt and along its length when not in use supporting a skateboard. The elastic bands 16 are stretched between their pivoting pins 15 and the retaining pin 18 so that the bands 16 are aligned with the strap when utilized as a belt, preventing the bands 16 from snagging other articles or hindering the device's use as a pants belt. Opposite of the coupling end of each strap section 11, 21 is a belt engagement end, 17, 23, which allows the strap to be connected around a user's waist and adjust for different sizes.

Figure 4:
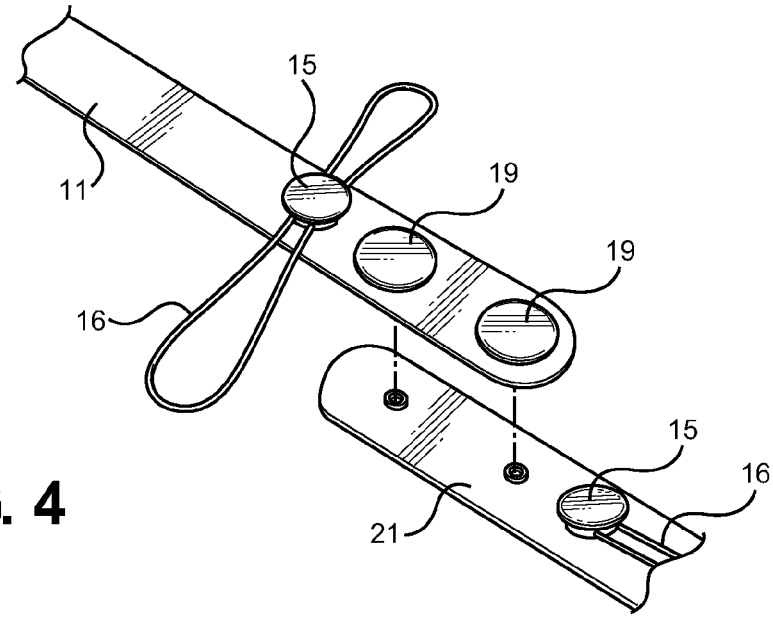
FIG. 4 is a close-up perspective view of the present invention depicting how the strap sections are connectable as well as the elastic band attachment.

Referring now to FIG. 4, there is shown a perspective close-up view of the coupling ends of the strap device illustrating how the two sections connect together. At least one connection means is provided at this end, wherein secure coupling of the two sections 11, 21 is achieved to allow for use of the connected strap sections as a belt. In a preferred embodiment, the connection means comprises at least one snap 19; however a number of different connection means are contemplated for this purpose, including buttons, hook and loop fastening or a second buckle connection. Also depicted in FIG. 4 is the elastic band 16 manipulated to form two distinct loops for connecting around a skateboard wheel truck using two loops rather than a single loop. The elastic band pin 15 allows the loop 16 to be fed through itself through two apertures, or an internal shaft that is partially enclosed. The elastic band is free to be pulled through this pin 15 and bear thereagainst, wherein the band may be placed in tension and be supported by the pin 15.

A combination over-the-shoulder strap for use carrying a skateboard on one's back and belt device is described. The device is a strap made from two smaller strap sections that come together to form a continuous belt device or separable skateboard support strap that accommodates a greater circumference by its decoupling structure. The smaller strap sections are coupled together to form an appropriate belt length having a buckling and buckle-receiving end. When operating as a skateboard support carrier, the strap has a set of elastic bands which an individual uses to attach a skateboard thereto and against the user's back. An individual manipulates the strap such that the strap lies against the top side of the skateboard and stretches the elastic band from the strap sections and around the sides of the board to catch the wheel trucks of the skateboard. Once the strap device is attached to the skateboard, an individual wears the strap around his or her torso by crossing the strap over his or her shoulder, whereby the skateboard lies against the individual's back with the wheels of the skateboard face away from the individual's body. The user leaves the buckle ends of the device connected to form a sash or shoulder-harness around across his or her torso. When the strap device is not in use holding a skateboard, an individual can wear it as a belt around the waist.

The present invention provides a new and novel carrying device that also functions as a standard pants belt. In light of the aforementioned prior art and the given disclosure, it is submitted that the instant invention is sufficiently differentiated from existing devices and has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination skateboard carrying device and garment belt, comprising:

an elongated strap having a first and second section;

said sections having a strap coupling end, a belt engagement end, and skateboard-attaching elastic bands;

said sections adapted to connect to one another at said strap coupling ends and belt engagement ends to form a continuous belt structure;

said elastic bands adapted to secure around a skateboard while said strap coupling ends are disconnected and said belt engagement ends are connected to support a skateboard against a wearer's back while said separated sections form an over-the-shoulder skateboard carrying strap;

said strap sections further comprising a retaining pin for securing said elastic bands against each section while in use as a belt.

2. The device of claim 1, wherein said elastic bands connect to said strap sections via a rotating pin having a pair of apertures wherein said bands fit through said pin apertures.

3. The device of claim 2, wherein each rotating pin allows each elastic band to bear against said pin for a single band skateboard engagement loop extending therefrom or a pair of skateboard engagement loops extending from opposing sides of said pin.

4. The device of claim 1, wherein said strap section coupling ends are connected via at least one snap engagement.

5. The device of claim 1, wherein said strap further comprises a shoulder pad along a section.

* * * * *